US010043646B2

(12) United States Patent
Brown et al.

(10) Patent No.: US 10,043,646 B2
(45) Date of Patent: Aug. 7, 2018

(54) METHOD OF GENERATING IONS OF HIGH MASS TO CHARGE RATIO BY CHARGE REDUCTION

(71) Applicant: Micromass UK Limited, Wilmslow (GB)

(72) Inventors: Jeffery Mark Brown, Hyde (GB); Jonathan Paul Williams, West Glamorgan (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/129,128

(22) PCT Filed: Mar. 24, 2015

(86) PCT No.: PCT/GB2015/050860

§ 371 (c)(1),
(2) Date: Sep. 26, 2016

(87) PCT Pub. No.: WO2015/145124

PCT Pub. Date: Oct. 1, 2015

(65) Prior Publication Data

US 2017/0125225 A1 May 4, 2017

(30) Foreign Application Priority Data

Mar. 24, 2014 (EP) ..... 14161312
Mar. 24, 2014 (GB) ..... 1405216.1
Mar. 28, 2014 (GB) ..... 1405661.8

(51) Int. Cl.
*H01J 49/00* (2006.01)

(52) U.S. Cl.
CPC ..... *H01J 49/0072* (2013.01); *H01J 49/0045* (2013.01)

(58) Field of Classification Search
CPC ..... H01J 49/0072; H01J 49/0045
(Continued)

(56) References Cited

U.S. PATENT DOCUMENTS 6,627,875 B2 9/2003 Afeyan et al.
6,727,497 B2 4/2004 Scalf et al.
(Continued)

FOREIGN PATENT DOCUMENTS

WO WO 2009127808 A2 * 10/2009 ..... H01J 49/0072

OTHER PUBLICATIONS

Brown et al., "Selective Ion-Ion Charge Reduction of Multiply Protonated Heterogeneous ESI Ions", Waters the Science of What's Possible, 2011.

(Continued)

*Primary Examiner* — Nicole Ippolito
*Assistant Examiner* — Hanway Chang
(74) *Attorney, Agent, or Firm* — Womble Bond Dickinson (US) LLP; Deborah M. Vernon; Heath T. Misley

(57) ABSTRACT

A method of charge stripping analyte ions is disclosed. The method comprises reacting the analyte ions with reagent ions or charged particles; and then urging the reacted analyte ions through a neutral, inert gas such that said analyte ions interact or collide with the gas molecules in a manner that reduces the charge state of the reacted analyte ions, thereby forming product ions of reduced charge state. The combination of reacting the analyte ions and then urging the reacted ions through the gas results in a charge reduction that is greater than that which would be caused by either of the individual steps of reacting the ions or urging the ions through the gas.

17 Claims, 12 Drawing Sheets

(58) Field of Classification Search
USPC ..... 250/281, 282, 283
See application file for complete search history.

(56) References Cited

U.S. PATENT DOCUMENTS

| | | | |
|---|---|---|---|
| 7,518,108 | B2 | 4/2009 | Frey et al. |
| 7,582,862 | B2 | 9/2009 | Hartmer |
| 8,288,716 | B2 | 10/2012 | Reilly |
| 8,440,962 | B2 | 5/2013 | Le Blanc |
| 9,070,539 | B2 | 6/2015 | Chen et al. |
| 9,111,740 | B2 | 8/2015 | Brown et al. |
| 9,299,553 | B2 | 3/2016 | Whitehouse et al. |

OTHER PUBLICATIONS

Lermyte et al., "ETD Allows for Native Surface Mapping of a 150 kDa Noncovalent Complex on a Commercial Q-TWIMS-TOF Instrument", J. AM. Soc. Mass Spectrom., vol. 25, p. 343-350, 2014.

* cited by examiner

METHOD OF GENERATING IONS OF HIGH MASS TO CHARGE RATIO BY CHARGE REDUCTION

CROSS REFERENCE TO RELATED APPLICATIONS

This application is the National Stage of International Application No. PCT/GB2015/050860, filed 24 Mar. 2015 which claims priority from and the benefit of United Kingdom patent application No. 1405216.1 filed on 24 Mar. 2014, European patent application No. 14161312.5 filed on 24 Mar. 2014, and United Kingdom patent application No. 1405661.8 filed on 28 Mar. 2014. The entire contents of these applications are incorporated herein by reference.

BACKGROUND TO THE PRESENT INVENTION

The present invention relates to a method and apparatus for charge stripping analyte ions.

Ionisation techniques, such as Electrospray Ionisation (ESI), facilitate the analysis of high molecular weight species by generating multiply charged ions. As these ions have relatively high charge states, when their mass to charge ratios are detected they fall into the low mass to charge ratio range of the spectrum. If a sample being analysed contains a mixture of ions of relatively high charge states then this can cause spectral congestion, because the mass to charge ratios of the ions become bunched at the low mass to charge ratio range of the spectrum. Even with extremely high mass resolving power or other separation methods this may result in ambiguities in assignments due to peak overlap and unknown charge states.

The charge carriers on the analyte ions in ESI techniques may be a mixture of protons, metal cations or cations from the electrospray solution, as well as counter ions.

It is known to reduce the charge states of analyte ions so as to reduce the above-described spectral congestion. As the charge states of the analyte ions are reduced, their mass to charge ratios are increased, thus spreading out the detected peaks along the mass to charge ratio scale.

For biopolymer ions, such as for example, native proteins and pegylated polymers, the ultimate spectral simplicity would be obtained if the charge state could be reduced to a relatively low value (i.e. to +/−1 or +/−2). The generation of singly charged ions is also beneficial for the study of non-covalently bound protein complexes. However, to the inventors' knowledge such complexes have not been observed before as singly charged ions.

It is known to perform ion-neutral reactions between analyte ion and superbase molecules in order to charge reduce the analyte ions. Such techniques may be used either in-source or under vacuum conditions. However, this technique may be undesirable due to the corrosive effects and toxicity of the superbases.

It is also known to employ in-source ion-ion reactions between analyte ions and reagent ions for the purpose of charge reducing the analyte ions. For example, reagent anions may be generated from a glow discharge device or via photoionisation processes. Such techniques show promise, although it is not known if the charge reduction techniques actually generate significantly higher mass to charge ratio ions, since ions having a mass to charge ratio beyond around 18000 (for a charge state of 2) are not observed at the detector.

In-vacuum ion-ion reactions between analyte ions and ETD reagents are also known. These techniques have demonstrated the ability to generate charge reduced ions via electron transfer and/or charge transfer to radical anions, as well as the observation of signature c and z type fragment ions. However, the published data has not revealed charge reduced ions of single charge state at relatively high mass to charge ratios.

It is desired to provide an improved method and apparatus for charge stripping analyte ions, an improved method and apparatus for performing mass spectrometry, and an improved method and apparatus for performing ion mobility spectrometry.

SUMMARY OF THE PRESENT INVENTION

From a first aspect the present invention provides a method of charge stripping analyte ions comprising:

reacting said analyte ions with reagent ions or charged particles; and then urging the reacted analyte ions through a neutral, inert gas such that said analyte ions interact or collide with the gas molecules in a manner that reduces the charge state of the reacted analyte ions, thereby forming product ions of reduced charge state.

This present invention relates to a method for charge reducing ions so as to increase their mass to charge ratio significantly relative to known charge reduction techniques. By way of example, the method is able to generate singly charged ions with mass to charge ratios above 60,000 and doubly charged peaks at mass to charge ratios of 74,000.

The combination of reacting the analyte ions and then urging the reacted ions through the gas results in a charge reduction that is greater than that which would be caused by either of the individual steps of reacting the ions or urging the ions through the gas.

For the avoidance of doubt, the term "inert" gas used herein means a gas that does not chemically react with the reacted analyte to cause the reduction in charge. Rather, the reduction in charge is caused by the reacted analyte colliding with the molecules of the inert gas. For example, the inert gas may, or may not be, a noble gas such as argon, nitrogen or helium.

Various methods of charge reduction are known. For example, EP 2450939 discloses reacting analyte ions with reagent ions in order to form fragment ions. The resulting fragment ions are then subjected to a superbase gas that charge reduces the fragment ions. However, this technique does not pass the analyte ions through the superbase gas to charge reduce the analyte ions, but passes the fragment ions through the gas. Furthermore, the technique chemically reacts the ions with the superbase gas to perform the charge reduction, rather than using an inert gas. This is because this document does not recognise that analyte ions can be charge reduced by the sequence of exciting the analyte ions by reacting them and then colliding the reacted analyte ions with a neutral, inert gas.

WO 2009/127808 and WO 00/17908 each disclose a method of charge reduction that comprises reacting the analyte ions with reagent ions. However, these documents also does not recognise that an inert gas can be used to strip charge off the analyte once the analyte has been reacted with reagent ions or charged particles.

WO 02/086490 discloses a method that reacts the analyte with either an ionic or neutral "quencher" so as to reduce the charge of the analyte ions. However, this document does not disclose that analyte ions are reacted with reagent ions and then reduced in charge by being urged through a neutral gas.

None of the prior art recognises that the sequence of reacting the analyte ions with reagent ions and then urging the reacted ions through a neutral gas can be used to enhance charge reduction of the analyte ions.

According to the method of the present invention, the step of urging the reacted analyte ions through the gas causes the analyte ions to be reduced in charge to a greater extent than they would have been reduced in charge if they had been urged through the gas without having first been subjected to said step of reacting said analyte ions with reagent ions or charged particles.

The step of reacting the analyte ions with reagent ions or charged particles may itself reduce the charge state of said analyte ions. In such methods, the subsequent step of urging the reacted analyte ions through the gas may cause the analyte ions of reduced charge state to interact or collide with the gas molecules in a manner that further reduces the charge state of these analyte ions, thereby forming said product ions of reduced charge state.

However, it is contemplated that said step of reacting said analyte ions alone may not cause said analyte ions to reduce in charge state, but may instead only affect (or energise) the analyte ions such that when they collide or interact with the gas molecules the charge reduction is effected. The collision energy between the analyte ions and the gas is preferably such that said analyte ions would not reduce in charge state had said analyte ions not previously been subjected to said step of reacting said analyte ions with reagent ions or charged particles.

Preferably, the step of reacting said analyte ions with reagent ions or charged particles does not cause fragmentation of the analyte ions that form said product ions.

Less preferably, the method may fragment some of the analyte ions, either via said step of reacting said analyte ions and/or via the collisions with the gas molecules. This may generate daughter ions (e.g. c-, z-. b- and y-ions) and these daughter ions may be used to identify their parent ions.

The gas molecules preferably reduce the charge state of the analyte ions by detaching charges from the analyte ions.

The method may comprise urging said analyte ions through said gas using an electrical potential difference, preferably wherein said potential difference is between 5 and 30 V.

The method may comprise urging the analyte ions through the gas using an electrical potential difference selected from the group consisting of: ≥2 V; ≥5 V; ≥10 V; ≥20 V; ≥30 V; 40 V; ≥50 V; ≥60 V; ≥70 V; ≥80 V; ≥90 V; ≥100 V; ≥120 V; ≥140 V; between 5 and 30 V; between 10 and 20 V; ≤140 V; ≤120 V; ≤100 V; ≤90 V; ≤80 V; ≤70 V; ≤60 V; ≤50 V; ≤40 V; ≤30 V; ≤20 V; ≤10 V; and ≤5 V; and/or urging the analyte ions through the gas using an electrical field selected from the group consisting of: ≥0.1 V/cm; ≥0.5 V/cm; ≥V/cm; ≥5 V/cm; ≥10 V/cm; ≥20 V/cm; ≥40 V/cm; ≥60 V/cm; ≥80 V/cm; 100 V/cm; ≥250 V/cm; ≥500 V/cm; ≥750 V/cm; ≥1000 V/cm; ≥1500 V/cm; and ≥2000 V/cm.

The gas that the analyte ions are urged through may comprise argon, nitrogen or helium. The gas may substantially consist of only argon, nitrogen or helium.

Alternatively, the gas may be another gas other than air. Less preferably, the gas may not be inert and may comprise a gas such as $SF_6$.

The step of urging said ions through said gas may comprise urging the ions through said gas at a pressure between $10^{-3}$ mbar and $10^{-1}$ mbar.

The step of urging said ions through said gas may comprise urging the ions through said gas at a pressure selected from the group consisting of: $\geq 10^{-3}$ mbar; $\geq 5\times10^{-3}$ mbar; a $10^{-2}$ mbar; $\geq 5\times10^{-2}$ mbar; $\geq 10^{-1}$ mbar; $\geq 5\times10^{-1}$ mbar; ≥1 mbar; ≥10 mbar; ≥50 mbar; ≥100 mbar; between $10^{-3}$ mbar and $10^{-1}$ mbar; ≤100 mbar; ≤50 mbar; ≤10 mbar; ≤1 mbar; $\leq 5\times10^{-1}$ mbar; $\leq 10^{-1}$ mbar; $\leq 5\times10^{-2}$ mbar; $\leq 10^{-2}$ mbar; $\leq 5\times10^{-3}$ mbar; and $\leq 10^{-3}$ mbar.

It is contemplated that any one of the voltage and/or electric field ranges described above may be combined with any one of the gas pressures combined above.

Preferably, said step of reacting said analyte ions comprises supplying reagent ions or charged particles to said analyte ions so as to result in electron transfer reactions to or from said analyte ions, proton transfer reactions to or from said analyte ions, or electron capture by said analyte ions.

The step of reacting said analyte ions may cause the charge state of the analyte ions to be reduced.

Preferably, the method reduces the charge state of the analyte ions to singly or doubly charged product ions. The singly or doubly charge product ions may have a mass to charge ratio selected from the group consisting of: ≥10,000; ≥15,000; ≥20,000; ≥40,000; ≥60,000; ≥80,000; ≥100,000; ≥120,000; ≥140,000; ≥160,000; ≥180,000; ≥200,000; ≥500,000; ≥1,000,000; ≥25,000,000; ≥50,000,000; ≥100,000,000; ≥200,000,000; ≥300,000,000; ≥400,000,000; ≥500,000,000; ≥600,000,000; ≥700,000,000; ≥800,000,000; ≥900,000,000; and ≥1000,000,000.

The method may comprise selecting or varying the charge state desired for the product ions and selecting or varying the energy with which said analyte ions are collided with the gas molecules such that at least some of said analyte ions are reduced in charge state to said desired charge state.

The method may comprise generating multiply charged analyte ions, and then performing said charge reduction steps on the multiply charged analyte ions. The multiply charged analyte ions may be generated by Electrospray Ionisation (ESI), although other ion generation techniques are also contemplated.

The method may comprise performing a scan mode in which the analyte ions are analysed so as to determine the charge state of the analyte ion that has the most intense signal. The method may comprise isolating analyte ions having a selected charge state from other ions, or isolating said analyte ions having the charge state that has said most intense signal; and then subjecting these isolated ions to said step of reacting said analyte ions and to said collisions with the gas molecules.

Preferably, the method further comprises mass analysing and/or ion mobility analysing said product ions; and/or further comprises identifying said product ions and/or using said product ions to identify said analyte ions or to identify an analyte from which said analyte ions are formed.

The analyte ions may be selected from the group consisting of: polymer ions; biopolymer ions; pegylated polymer ions; pegylated proteins ions; native protein ions; monoclonal antibody ions; recombinant monoclonal antibody drug ions; non-covalently bound protein complex ions; ions of protein complexes in their native state; bio-conjugated drug ions, such as pegylated protein or lipid ions; RNA or DNA ions; and haemoglobin ions.

From a second aspect, the present invention also provides a method of charge stripping analyte ions comprising:

(i) reacting said analyte ions with reagent ions or charged particles; and then (ii) urging the reacted analyte ions onto a solid surface or illuminating the reacted analyte ions with photons, thereby forming product ions of reduced charge state.

Optionally, step (i) reduces the charge state of said analyte ions and step (ii) further reduces the charge state of the analyte ions.

The method of the second aspect may comprise any one or combination of the preferred or optional features described herein with respect to the first aspect of the invention, except that collisional gas is not used to reduce the charge of the analyte ions.

The present invention also provides a method of mass spectrometry or ion mobility spectrometry comprising a method as described herein, and further comprising mass analysing and/or ion mobility analysing said product ions.

The present invention also provides a method of mass spectrometry comprising:

(i) mass selectively isolating analyte ions having mass to charge ratios below an upper threshold;

(ii) charge stripping the isolated analyte ions according to a method as described herein so as to form said product ions; and then (iii) mass analysing the product ions so as to obtain spectral data;

(iv) identifying ions, or determining the presence of ions, in the spectral data having a mass to charge ratio above said upper threshold.

The step of isolating the analyte ions may be performed by mass filtering ions or by using a mass selective ion trap.

The step of isolating the analyte ions may isolate ions of a single mass to charge ratio, or isolate ions having mass to charge ratios between a lower threshold and said upper threshold.

A multipole rod set may be used as the mass filter. The high mass cut off of the multipole mass filter may correspond to said upper threshold. The low mass cut off of the multipole mass filter may correspond to said lower threshold.

The first aspect of the present invention also provides an apparatus for charge stripping analyte ions comprising:

a reaction region;

an analyte ion source for supplying analyte ions to said reaction region;

a source of reagent ions or charged particles for supplying analyte ions or charged particles to said reaction region;

a gas region; and a controller arranged and adapted to:

(i) supply said analyte ions and reagent ions or charged particles to said reaction region such that said analyte ions react with said reagent ions or charged particles; and then (ii) urge said analyte ions through a neutral, inert gas in said gas region such that said analyte ions interact or collide with the gas molecules in a manner so as to reduce the charge state of the analyte ions, thereby forming product ions of reduced charge state.

The apparatus may further comprise a supply of said neutral, inert gas for supplying the neutral, inert gas to the gas region.

Optionally, step (i) reduces the charge state of said analyte ions and step (ii) further reduces the charge state of the analyte ions.

The apparatus may be arranged and configured to perform any one of the methods described herein.

The second aspect of the present invention provides an apparatus for charge stripping analyte ions comprising:

a reaction region;

an analyte ion source for supplying analyte ions to said reaction region;

a source of reagent ions or charged particles for supplying analyte ions or charged particles to said reaction region;

a solid surface or photon source; and a controller arranged and adapted to:

(i) supply said analyte ions and reagent ions or charged particles to said reaction region such that said analyte ions react with said reagent ions or charged particles; and then (ii) urge the reacted analyte ions onto the solid surface or illuminate the reacted analyte ions with photons from said photon source, thereby forming product ions of reduced charge state.

The apparatus may be arranged and configured to perform any one of the methods described herein.

The present invention also provides a mass spectrometer or an ion mobility spectrometer comprising an apparatus as described herein, preferably further comprising a mass analyser and/or ion mobility analyser for analysing said product ions.

The present invention also provides a mass spectrometer comprising:

a mechanism for isolating ions having mass to charge ratios below an upper threshold;

an apparatus as described herein that is arranged and configured for charge stripping the isolated analyte ions to form said product ions;

a mass analyser for analysing said product ions so as to obtain spectral data; and a controller configured to identify ions, or determine the presence of ions, in the spectral data having a mass to charge ratio above said upper threshold.

Said mechanism may be a mass filter or a mass selective ion trap.

The spectrometer described herein may comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The spectrometer may comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The spectrometer may comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide is preferably maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

This present invention relates to an apparatus and method for charge reducing ions so as to increase their mass to charge ratio significantly relative to known charge reduction techniques. By way of example, the method is able to generate singly charged ions with mass to charge ratios above 60,000 and doubly charged peaks at mass to charge ratios of 74,000.

The method comprises a first step of subjecting the multiply charged analyte ion to an ion-ion reaction. For example, multiply charged ions may be generated using an electrospray ion source and these may undergo ion-ion reactions with an anion such as an anion of the type used for Electron Transfer Dissociation (ETD). The method provides a subsequent step of subjecting the analyte ion to mild collisional activation of the charge reduced species. This further charge strips the ions so as to further reduce their charge and provides substantially higher mass to charge ratio ions than previously observed. Activation methods other than collisional activation are contemplated in less preferred embodiments, including colliding the ions with a solid surface or photon based ion activation, e.g. whereby the ions are illuminated by a discharge lamp or laser.

It is known to subject analyte ions to ETD reactions for the purpose of fragmenting the analyte ions. It is also known that some of the analyte ions may not fragment fully under the ETD conditions and so it may be necessary to induce fragmentation by applying a subsequent Collisional Induced Dissociation (CID) step. However, this is to be contrasted to the present invention in that such know techniques use high collisional energies in the CID step so as to fragment all of the ions that have not fragmented under the ETD conditions. In contrast to the known techniques, the present invention is different in that the purpose of the ion-ion reactions is to reduce the charge of the analyte ions and the subsequent collisional step is performed at relatively low energies so as to further charge reduce the analyte ions, rather than for ensuring that the analyte ions fragment.

The method of the present invention can be used in various applications to improve the analysis of analytes. For example, in the bio-pharmaceutical industry, the simplification and more reliable identification and characterisation of mixtures of large molecular weight samples such as monoclonal antibodies or pegylated proteins is of great interest. The technique of the present invention facilitates the comparative studies between ions in the gas phase versus the solution phase. Previously, the range of charges accessible by mass spectrometry, even after charge stripping, was limited to those provided by the ionisation process (e.g. ESI or MALDI). The ability of the present invention to generate charge states over a greater range allows for the selection and subsequent study of the same charge states that exist naturally. It is anticipated that the conformations of these ions might ideally match those in the natural solution phase. These new gaseous ions can now be analysed by MS/MS, ion mobility or Hydrogen-Deuterium Exchange (HDX) for a significantly extended set of charge states (that were previously unattainable).

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENT

Figure 1:
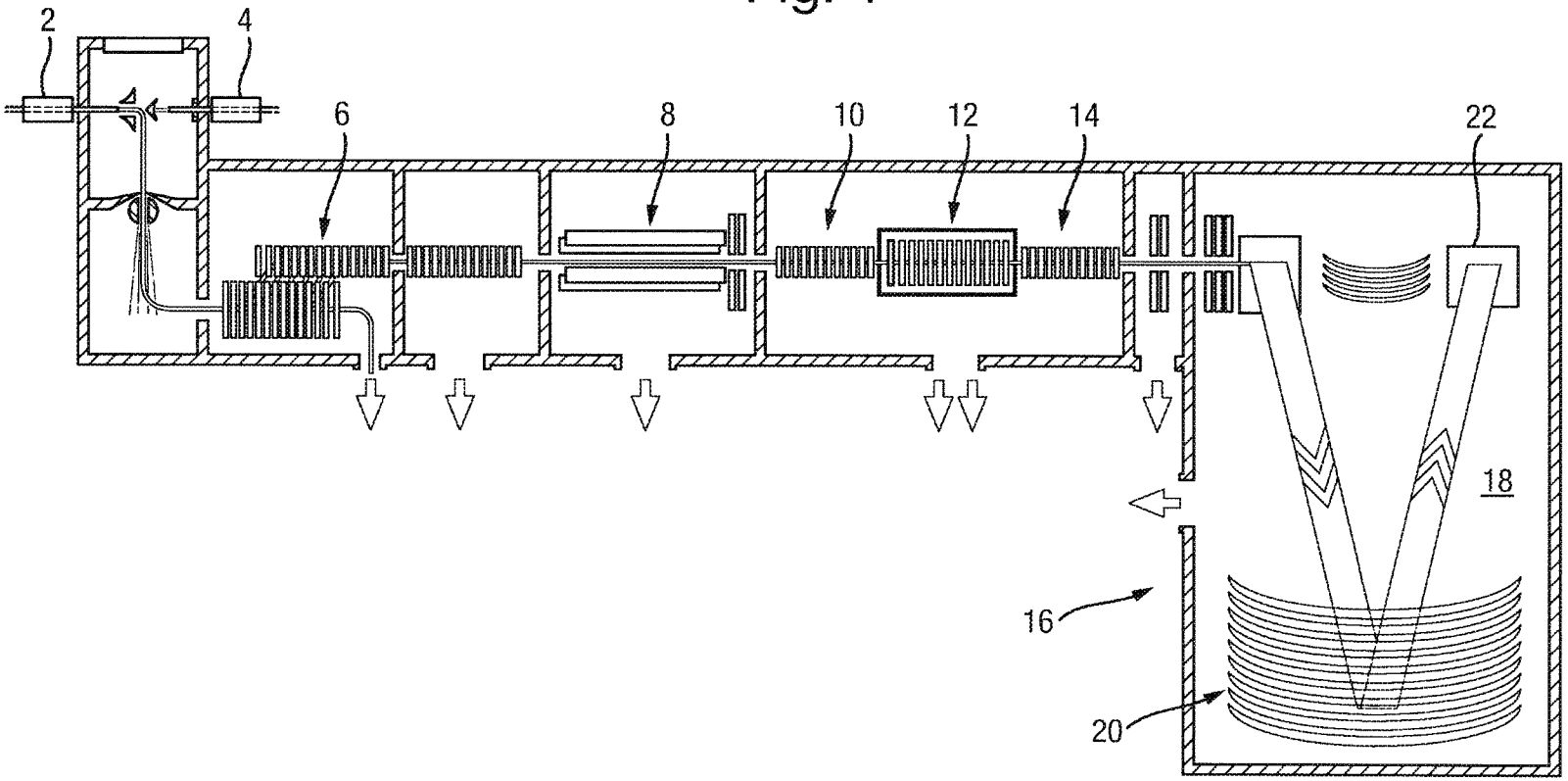
FIG. 1 shows a schematic of a mass spectrometer according to a preferred embodiment of the present invention.

FIG. 1 shows a mass spectrometer according to a preferred embodiment of the present invention. In operation, an analyte sprayer 2 sprays analyte ions into the spectrometer and a lock mass sprayer 4 sprays calibrant ions into the spectrometer for use in calibrating the device. The ions pass through a stepwave ion guide 6, a quadrupole 8 and into an ion trap 10. Ions are pulsed out of the ion trap 10 and into an ion mobility separator 12 that is filled with helium gas. The ions separate in the ion mobility separator 12 and are then transmitted through a transfer lens 14 to an orthogonal acceleration time of flight (TOF) mass analyser 16. In the TOF mass analyser 16, ions are pulsed orthogonally to the axis along which the ions entered the TOF analyser 16. The ions travel through a flight region 18 and are reflected by a reflectron 20 onto an ion detection system 22. As the ions travel through the flight region 20 they separate according to their mass to charge ratio. The time difference between the pulsing of an ion and its detection can therefore be used to determine its mass to charge ratio.

According to a preferred method of the present invention, protein complexes in their native state (dissolved in 100 mM ammonium acetate) are ionised by a static nanospray, i.e. by the analyte sprayer 2. A scan mode may be performed to detect which precursor analyte ions have the most intense charge state. These analyte ions may then be selectively transmitted by the quadrupole 8 such that substantially only these ions enter the ion trap 10. The radical 4-nitrotoluene is preferably also provided to the ion trap 10 so as to act as an ETD reactant anion that causes ion-ion reactions with the analyte ions, thereby producing product ions. The product ions are then accelerated through an argon background gas by a potential difference between 10 to 20 V, which generates charge reduced ions having high mass to charge ratios. The TOF mass analyser 16 then records these charge reduced ions at an elevated detector voltage.

Without wishing to be bound by theory, it is currently believed that during the initial ion-ion reactions some charge transfer occurs directly from the analyte cation to the anion, or from the anion to the cation, but the remainder of charge carriers remain on the analyte ion. It is believed that these remaining charge carriers become more amenable to detachment from the analyte ions by a supplemental activation technique that accelerates the analyte ions so as to collide with a background gas, possibly because the initial ion-ion reaction is exothermic. The supplemental activation technique may cause protons or cations to be detached or desolvated from the analyte ions almost completely with only modest collisional energy. It is believed that charge detachment, rather than charge transfer reactions, is the mechanism that charge-reduces the analyte ions during the supplemental activation step, as charge acceptors are not present in the neutral background gas that the ions are accelerated through.

Figure 2A:
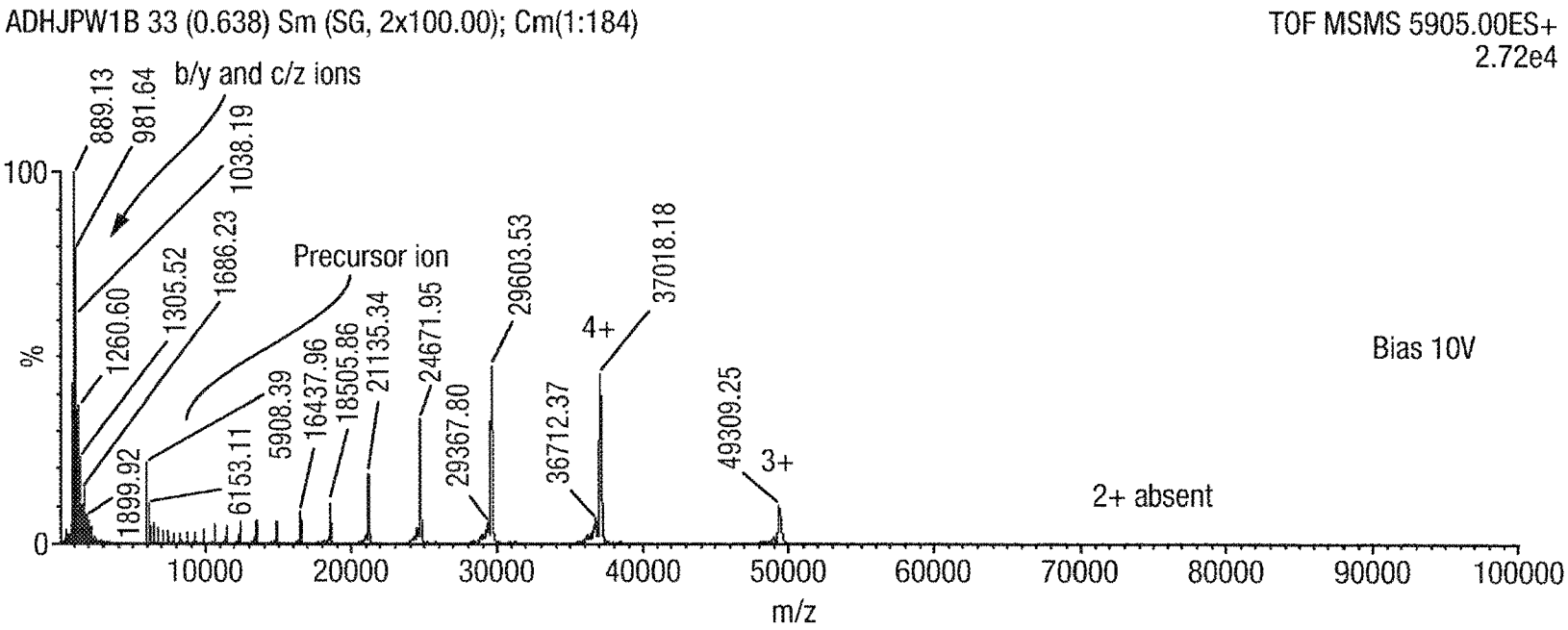
FIGS. 2A and 2B show mass spectral data obtained after subjecting ADH tetramer ions to ETD conditions and then using different potential differences to urge the resulting product ions through a collisional gas.
Figure 2B:
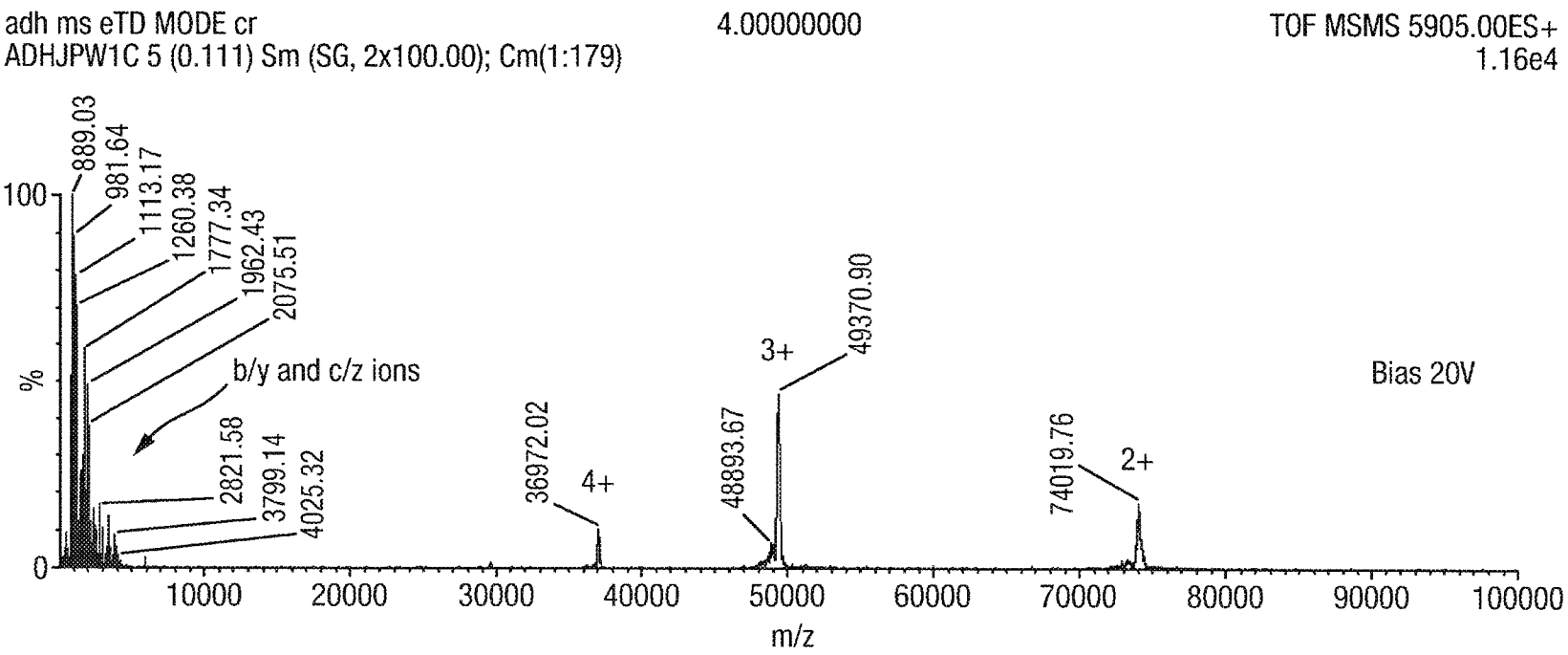

FIGS. 2A and 2B show spectral data obtained for the analysis of native ADH tetramer after ion-ion reactions under ETD conditions. In order to obtain the spectral data of FIG. 2A, the product ions resulting from the ion-ion reactions were transmitted through a background gas by a very low potential difference. In order to obtain the spectral data of FIG. 2B, the product ions resulting from the ion-ion reactions were transmitted through a background gas by a moderate, but higher potential difference of 20 V. It can be seen by comparing FIGS. 2A and 2B that by accelerating the ions through the background gas at the moderate potential difference, the signal intensity of the 3+ and 4+ ions was reduced and the appearance of 2+ ions was observed at m/z~74000. This demonstrates the enhanced charge reduction effect caused by accelerating the ions through the background gas at the moderate potential difference.

Therefore, increasing the DC potential difference (or transfer collision energy) occurring downstream of the ETD/PTR ion-ion reactions causes ion charge states to be reduced significantly. The charge reduced product ions generated through the ion-ion reactions in the trap cell 10 are significantly charge stripped during mild collision conditions after the trap cell 10. This has not been shown before. The improved charge state reduction may also be enhanced by factors, such as the use of native proteins (with reduced charge load) and/or higher detector voltage or gain.

Figure 3A:
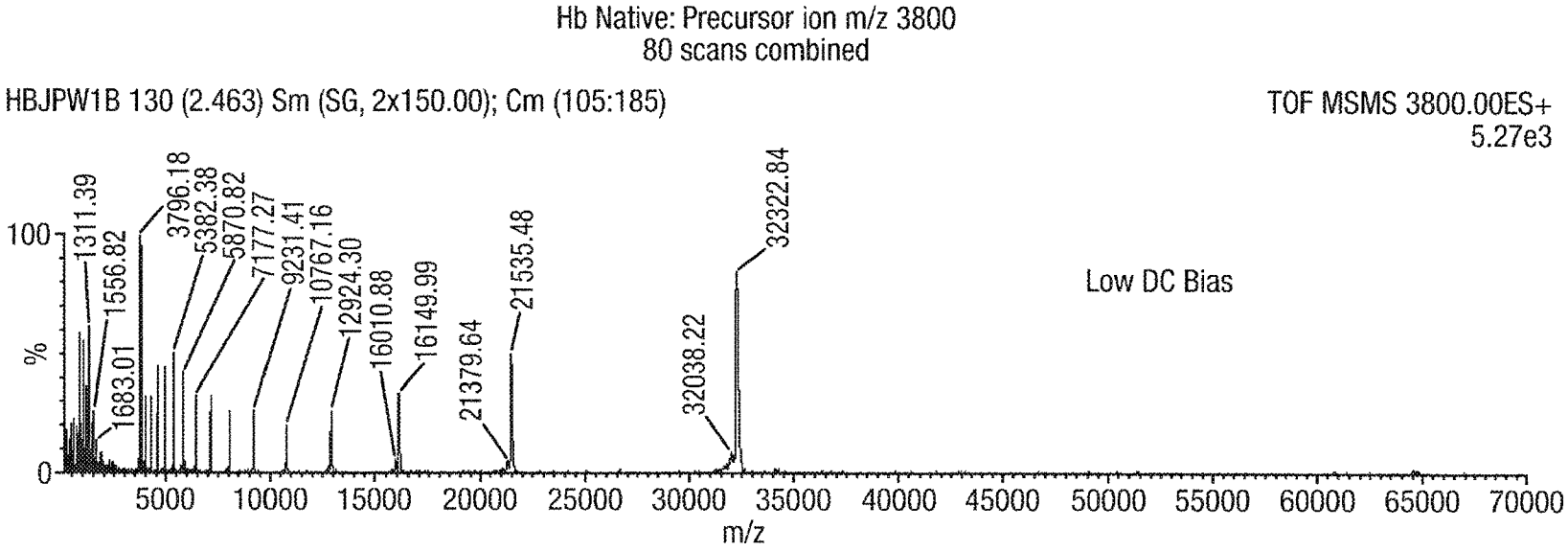
FIGS. 3A to 3C show mass spectral data obtained after subjecting Haemoglobin ions to ETD conditions and then using different potential differences to urge the resulting product ions through a collisional gas.
Figure 3B:
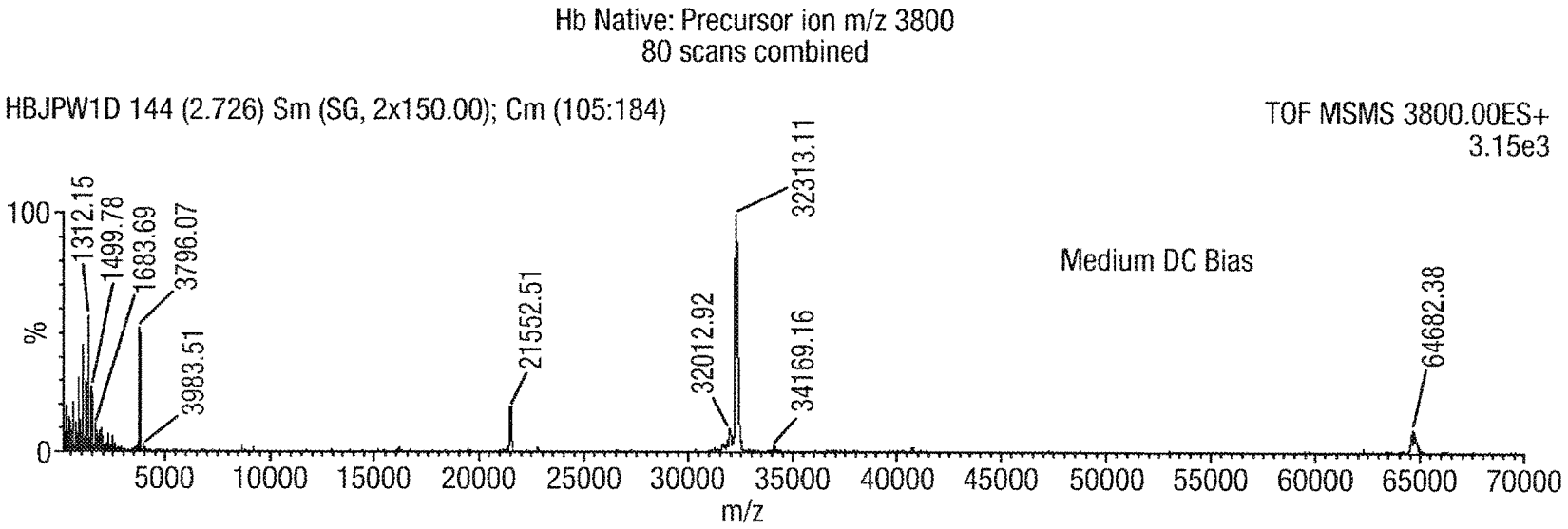
Figure 3C:
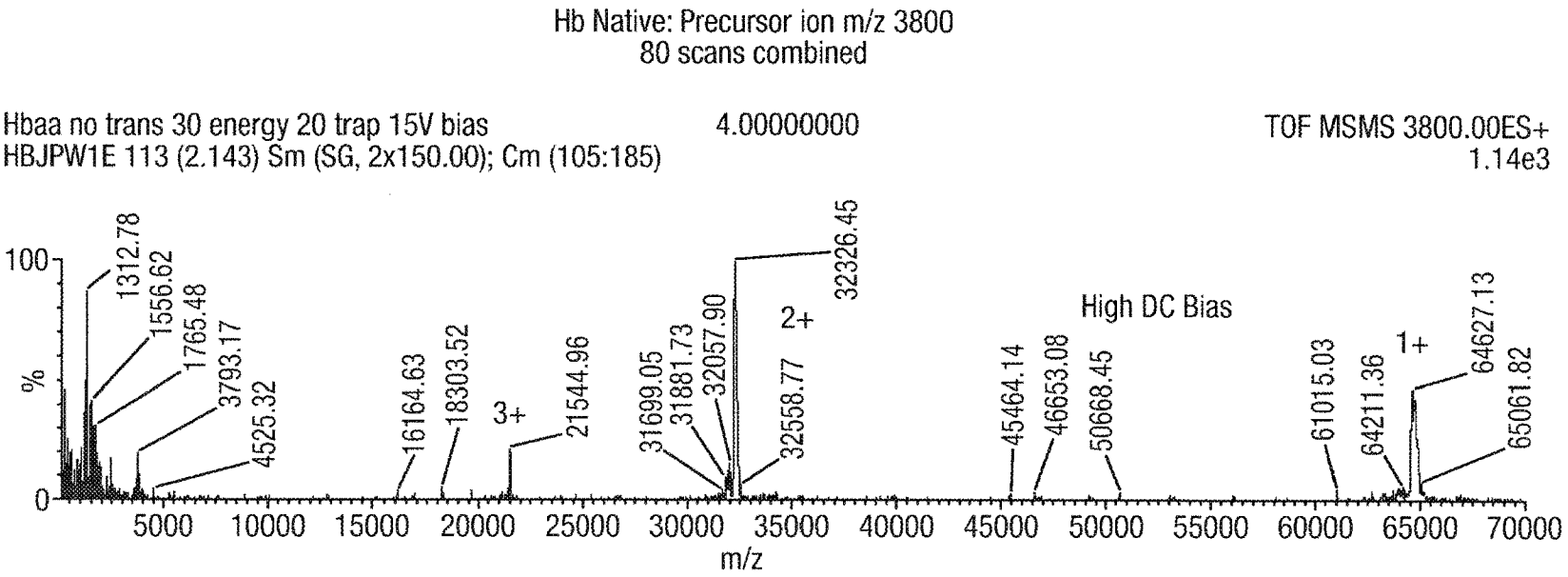

FIGS. 3A to 3C show spectral data obtained for the analysis of native haemoglobin after ion-ion reactions under ETD conditions and then subsequently transmitting the ions through a background gas. The spectral data shown in FIGS. 3A to 3C uses different, and progressively higher, potential differences in order to transmit the ions through the background gas. It can be seen from comparing the three plots of FIGS. 3A to 3C that increasing the potential difference causes an increase in the signal detected of the singly charged tetramer at m/z~64500. This is due to increased charge reduction of the haemoglobin ions. Interestingly, the non-covalently bound tetramer managed to survive intact to pass to the detector, and b/y and c/z fragment ions were observed in the same spectrum at low m/z. Such information is invaluable and may be used, for example, in phenotyping haemoglobin variants.

The data shown in FIGS. 2 and 3 also suggests that the non-covalent hydrogen bonding of the tetramer is significantly unaffected by the change in the charge carriers, which possibly "evaporate" from the outer surface of the ion.

The preferred embodiment of the present invention enables the user to select the charge state of interest that is desired and then reduce the charge state of the analyte ions to the desired charge state. This may be achieved, for example, by selecting a potential difference that is used to drive the analyte ions through the collision gas.

According to a preferred embodiment of the present invention, the method may be used to improve the analysis of recombinant monoclonal antibody drugs. For example, it is desired to analyse biopharmaceutical monoclonal antibodies (MABs) (e.g. Immunoglobulin at approximately 150 kDa) of low charge or singly charged ions by their molecular weight and/or ion mobility so as to provide unambiguous assignments of the dominant forms. This is an essential requirement in the Biopharma industry as the macro-heterogeneity of the drug is important to characterise and maintain consistency of efficacy from batch to batch.

The method may be used to improve the analysis of bio-conjugated drugs. For example, the analysis of drugs composed of pegylated proteins and/or lipids becomes possible with improved charge reduction of the analyte ions.

The method may be used to improve analysis of (complex) RNA/DNA anions by charge stripping the anions.

The method may be used to improve analysis of haemoglobin, for example, for phenotyping.

The method may be used to compare protein footprinting and improve correlation with X-ray crystallography and hydrogen-deuterium exchange (HDX). Ideally, the mass spectrometry of ions with the same charge state (and potentially the same structure) as the "native" in-solution biological state of the protein is desired. Generation of charged proteins over a greater range of m/z (approaching +/−1 charge state) allows more complete characterisation and study of the collisional cross-sections for comparisons with other techniques. The ability to choose a charge state of interest facilitates this goal and is provided by this invention and with ion mobility provides a means of comparing the structures with those attained via X-ray crystallography and NMR.

Furthermore, ETD c and z fragment ions obtained at low m/z from the charge reduced ions can also be used to "footprint" the intact protein and it has been shown previously that the existence of the fragment ions correlate with the exposed areas on the surface of the ions as defined by the "b-factor" measured from crystallography structures. By "footprinting" at low charge state, the inferred structures may be more likely to match those measured by crystallography due to the significantly reduced coulombic repulsion.

The charge reduction method may also be used to improve analysis of polymers, such as industrial polymers. For polymers, it is advantageous to improve the method by sequentially scanning the mass to charge ratios of the precursor ions being charge-reduced and analysed. The method of the present invention provides a limited portion of charge reduced polymer ions at higher m/z after the charge stripping by the ion-ion reactions and the supplemental activation. By charge stripping according to the present invention, only a narrow band of m/z (e.g. a precursor ion transmitted in the scan) with limited charge load is analysed. This is beneficial when the ions are trapped, because it is necessary to balance the positive and negative charges in the trapped region cell. The full polymer spectrum is then reconstructed by combining the individual charge stripped spectra obtained for each precursor in the scan. This technique provides information about the polydispersity of the polymer. This technique also provides information about the end groups or protein conjugates of the polymer. For example, as described above, the method may be used to improve the analysis of bio-conjugated drugs, such as drugs composed of pegylated proteins and/or lipids.

As discussed above, the charge-reduction technique of the present invention enables the disentanglement of overlapping ions in a spectrum. This is invaluable for the study of both homogeneous and heterogeneous synthetic polymers using mass spectrometry based techniques.

Synthetic polymers play an important part in everyday life and are used, for example, in medical devices, automobiles, plastic bags etc. Polymer systems exhibit a wide range of physical properties. Differences in these properties have resulted in the polymers being used for a variety of different applications. The performance of these materials is dependent on a number of factors such as the initiating and/or terminating end groups of the polymer, the molecular weight distribution and the monomeric units.

As a consequence, there is great interest in characterising the detailed micro/macro structure of synthetic polymers and to relate this information to their structural and functional properties.

Synthetic polymers are comprised of a composition of many molecules of a variety of sizes. There are a variety of analytical techniques commonly employed to gain structural analysis of synthetic polymers, such as vibrational spectroscopy, NMR and GPC/SEC. Mass spectrometry can complement these techniques and provide useful and vital information regarding monomeric repeat unit, end-groups, average molecular weight distribution together with backbone micro-structure following MS/MS.

Both ESI and MALDI are routinely used for studying synthetic polymers. MALDI spectra are less complex since lower charge states are typically obtained, e.g. 2+ and 1+. However, it is difficult to interface a MALDI device with some form of separation device, such as a chromatographic separation, in order to aid the analysis of complex synthetic polymers. An ESI technique on the other hand produces mainly multiply charged ions that often complicate the mass spectrum, particularly at low mass to charge ratios, due to the vast number of overlapping ions of many different charge states. Some forms of separation techniques are more straightforward to interface with ESI and can possibly aid the analysis of analytes and interpretation of the resulting data.

The molecular weight distribution of a polymer is a very important property, because a variation in this mean value and the distribution can affect the physical properties of the material. Charge-reduction mass spectrometry can enables rapid and accurate analysis of the average molecular weight information of polymers. For example, the technique of the present invention has been used to charge-reduce a PEG 8K polymer so as to disentangle ions in the spectrum that would otherwise overlap, without the need of a separation device for separating the ions. This is described below with reference to FIGS. 4-7.

Figure 4:
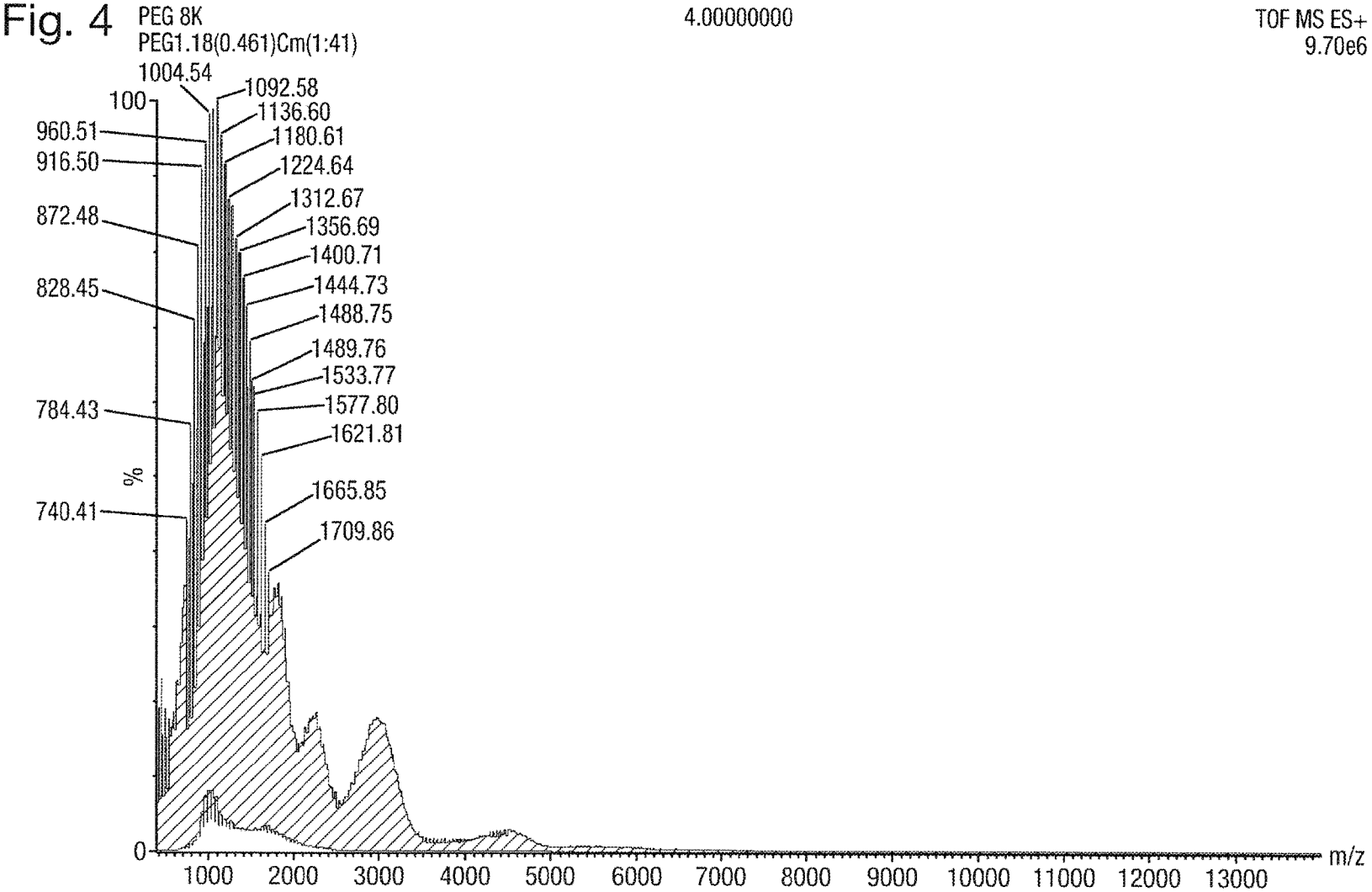
FIG. 4 shows a mass spectrum obtained by direct infusion of 1 mg/mL PEG 8K (0.1M Ammonium Acetate) into a mass spectrometer.

FIG. 4 shows a mass spectrum obtained by direct infusion of 1 mg/mL PEG 8K (0.1M Ammonium Acetate). In this spectrum, the multiply charged ions overlap.

Figure 5:
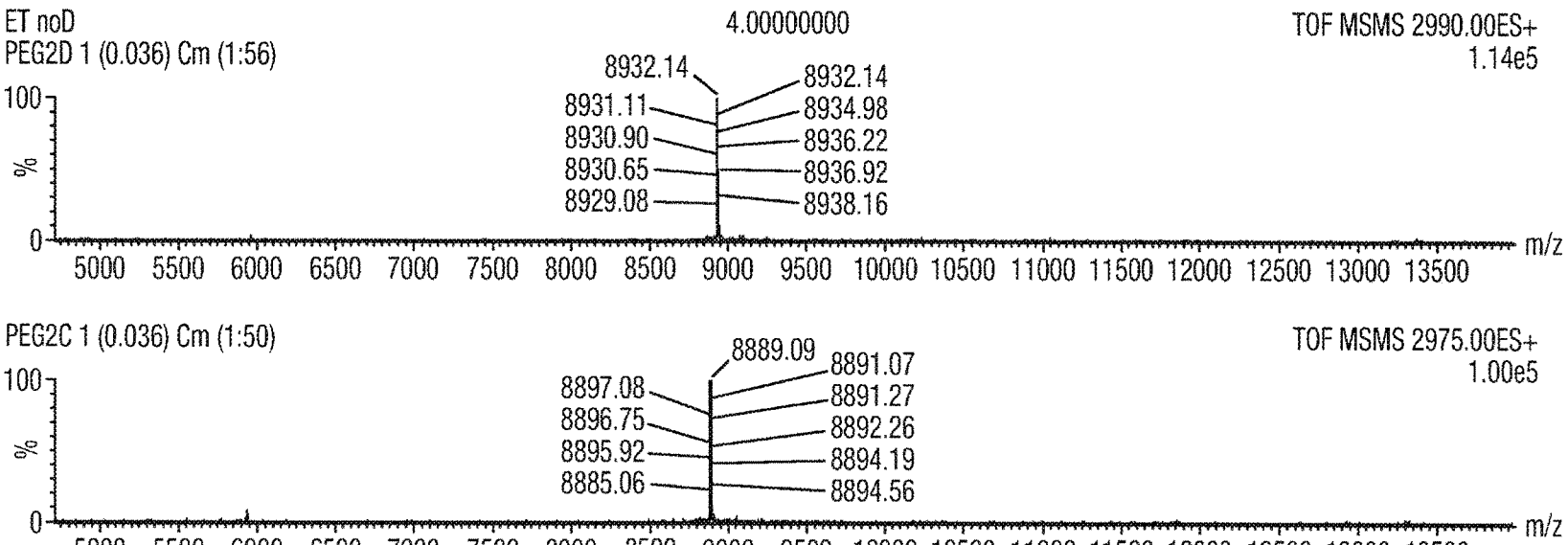
FIG. 5 shows five spectral peaks for ions that have been charge reduced according to the present invention to the 1+ charge state.
Figure 5:
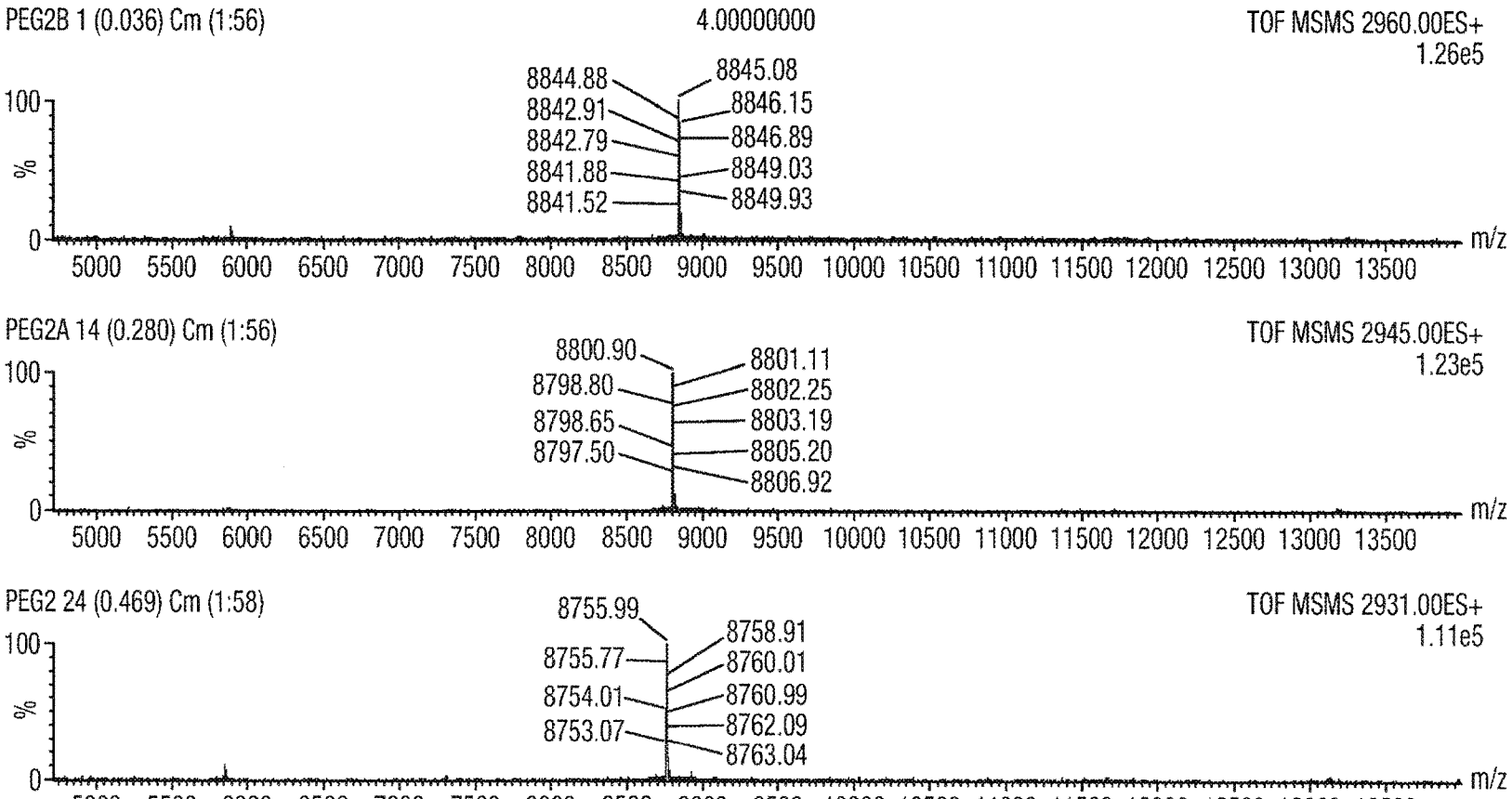

FIG. 5 shows spectral peaks of five triply charged ions that have been selected from the sample analysed in FIG. 4 having mass to charge ratios of 2931, 2945, 2960, 2975 and 2990, and that have then been charge reduced according to the present invention to the 1+ charge state.

Figure 6:
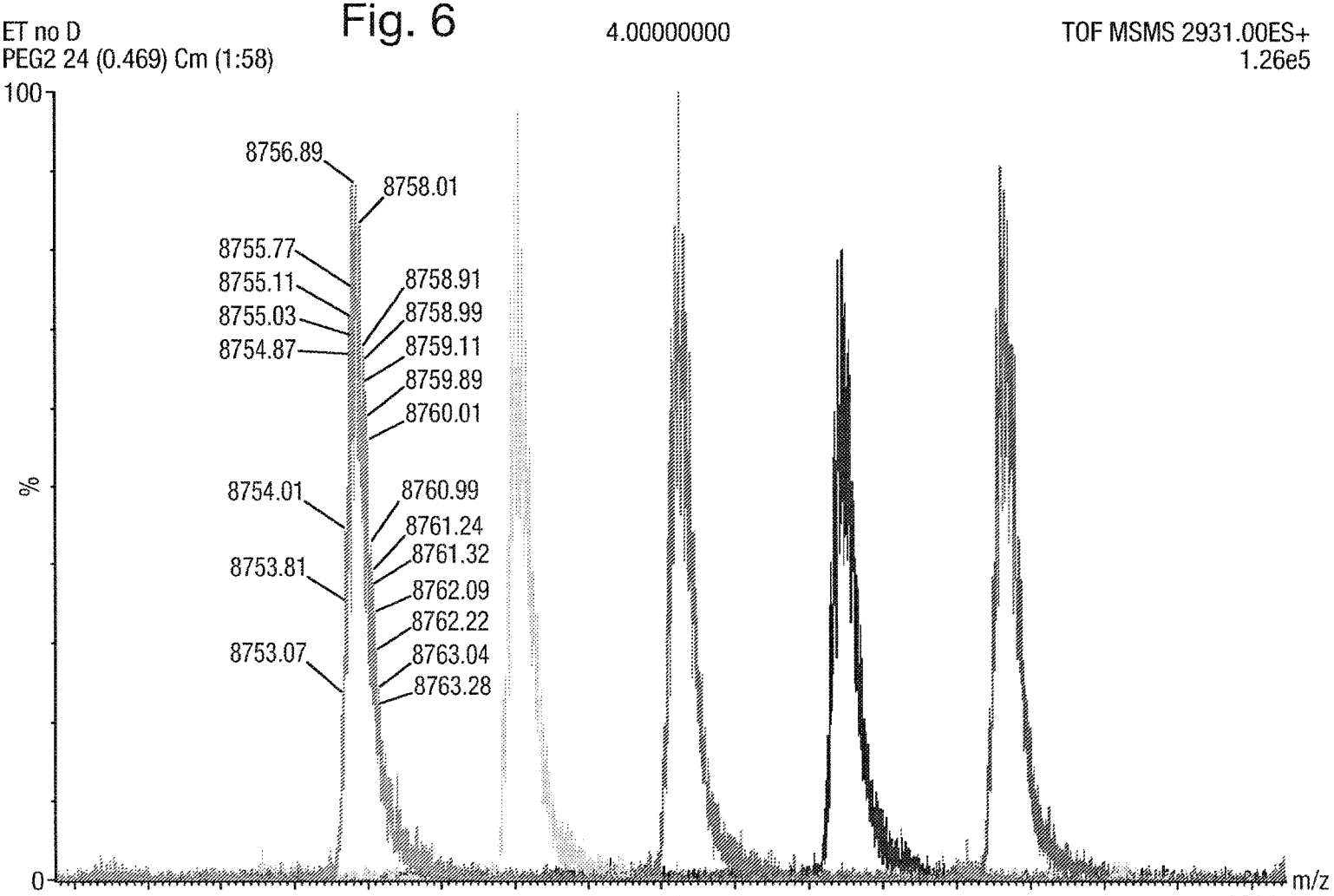
FIG. 6 shows the spectra 5 spectra of FIG. 5 overlaid.

FIG. 6 shows the spectra 5 spectra of FIG. 5 overlaid.

Figure 7:
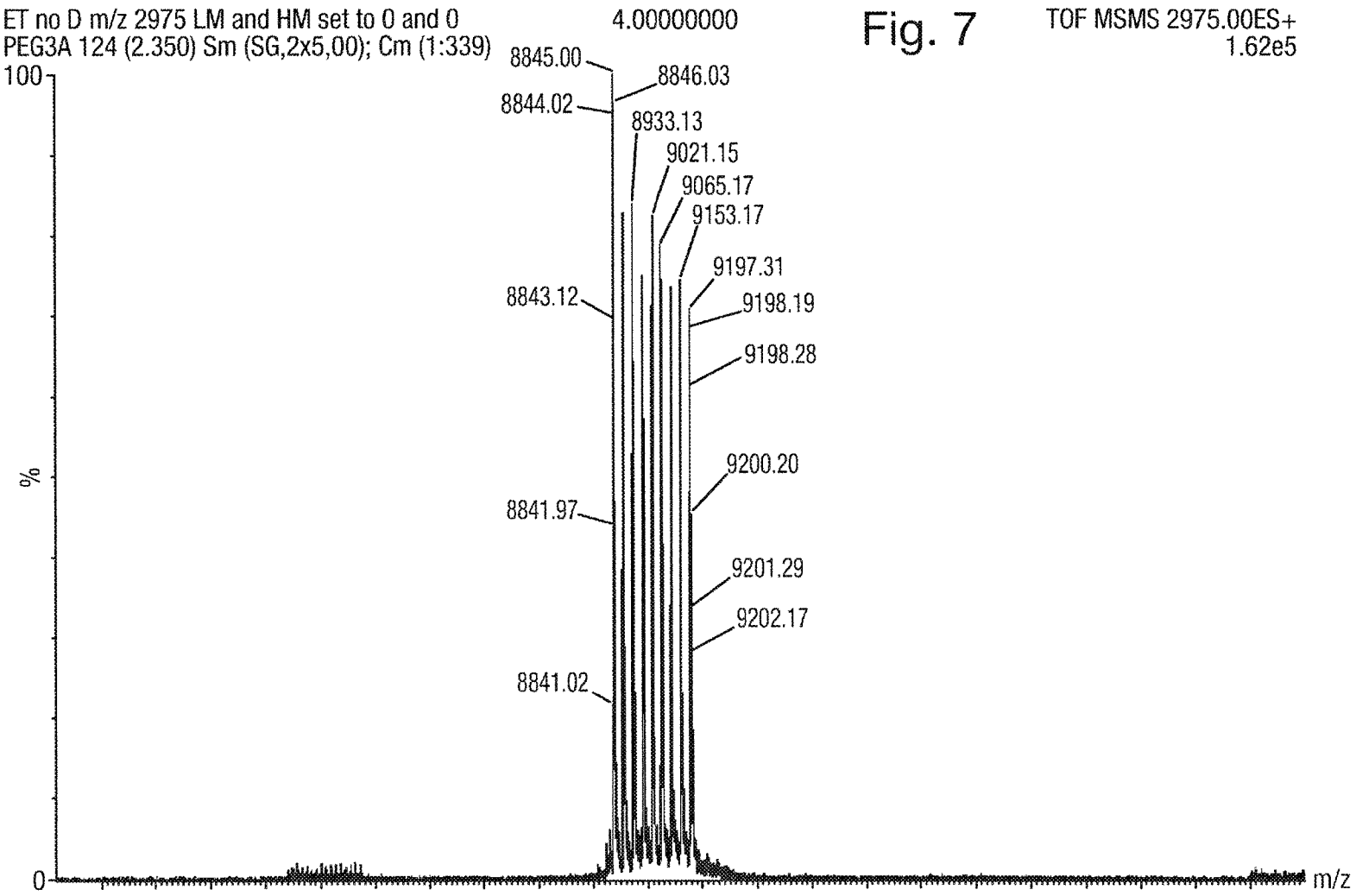
FIG. 7 shows a spectrum obtained by charge-reducing a cluster of nine 3+ oligomers at the same time to produce to 1+ product ions.

FIG. 7 shows a spectrum obtained by charge-reducing a cluster of nine 3+ oligomers at the same time to produce to 1+ product ions.

It is envisaged that some form of "spectral-stitching" may be used to show the full bell shaped distribution of the 1+ charge-reduced products.

It is envisaged that the technique of the present invention will be invaluable for the study of both homogeneous and heterogeneous synthetic polymers using mass spectrometry based techniques. Furthermore, backbone sequence information can also be obtained from the resulting mass spectrum.

The method and apparatus of the present invention may perform an in source ion-ion charge-stripping reaction followed by supplemental collision of the analyte ions with a collision gas so as to perform further charge stripping, preferably by charge detachment.

Figure 8:
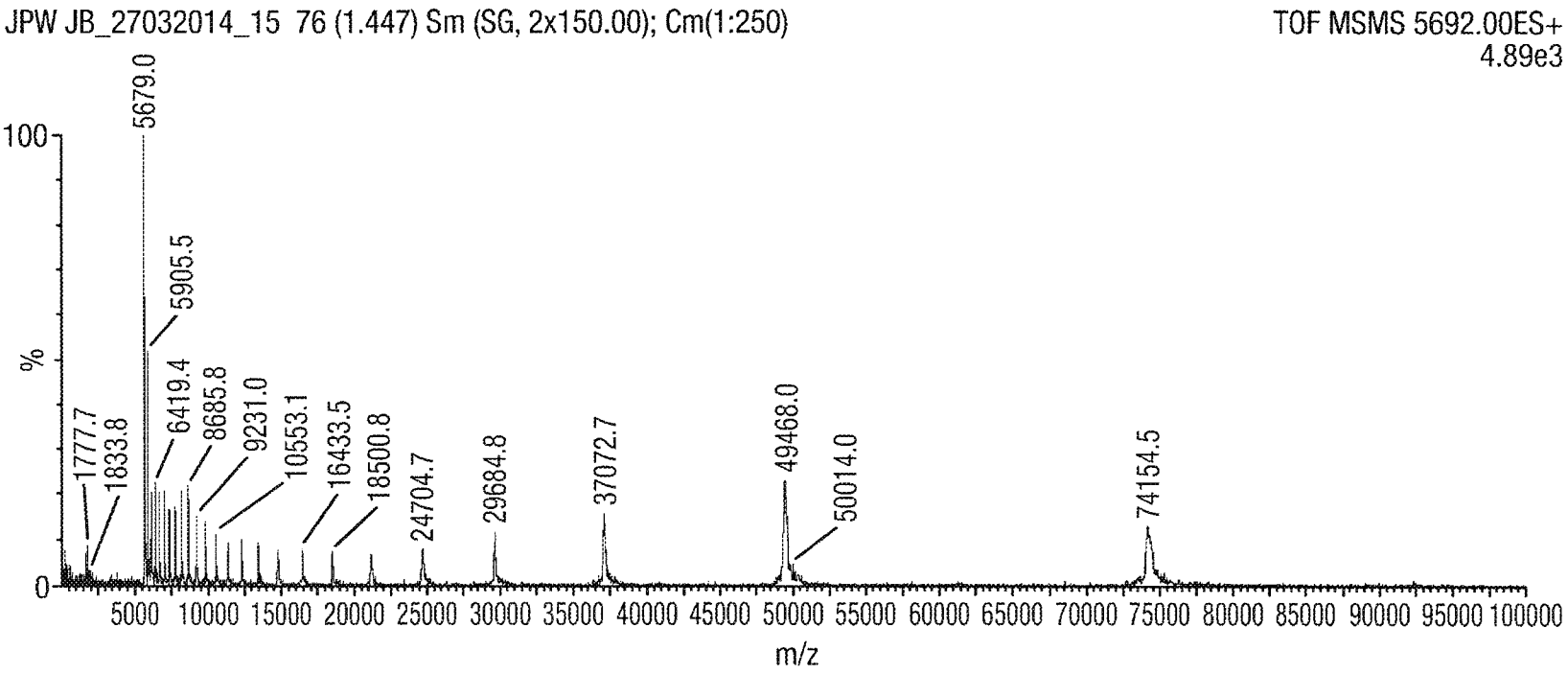
FIG. 8 shows a spectrum obtained by charge-reducing, using nitrotoluene as the ETD reagent followed by supplemental activation in accordance with a preferred embodiment of the present invention.

FIG. 8 shows further experimental results which were obtained using nitrotoluene having a mass to charge ratio of 137 as the reagent anion followed by supplemental activation in accordance with a preferred embodiment of the present invention.

Although the present invention has been described with reference to preferred embodiments, it will be understood by those skilled in the art that various changes in form and detail may be made without departing from the scope of the invention as set forth in the accompanying claims.

According to the present invention, the reagent anions or negatively charged ions may be derived from a polyaromatic hydrocarbon or a substituted polyaromatic hydrocarbon. Alternatively, the reagent anions or negatively charged ions may be derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone.

Alternatively, the reagent anions or negatively charged ions may comprise azobenzene anions or azobenzene radical anions.

According to a particularly method the reagent ions or negatively charged ions comprise either dicyanobenzene, nitrotoluene or azulene.

The invention claimed is:

1. A method of charge stripping analyte ions comprising:

reacting said analyte ions with reagent ions or charged particles; and then urging the analyte ions through a neutral, inert gas such that said analyte ions interact or collide with the gas molecules in a manner that reduces the charge state of the analyte ions, thereby forming product ions of reduced charge state;

wherein the step of urging the analyte ions through the gas causes the analyte ions to be reduced in charge to a greater extent than they would have been reduced in charge if they had been urged through the gas without having first been subjected to said step of reacting said analyte ions with reagent ions or charged particles.

2. The method of claim 1, wherein said step of reacting said analyte ions with reagent ions or charged particles does not cause fragmentation of the analyte ions that form said product ions.

3. The method of claim 1, wherein said step of interacting or colliding said analyte ions comprises colliding said analyte ions with said gas molecules with a collision energy that results in said analyte ions reducing in charge state without being fragmented.

4. The method of claim 1, comprising urging said analyte ions through said gas using an electrical potential difference, preferably wherein said potential difference is between 5 and 30 V.

5. The method of claim 1, wherein said gas comprises argon, nitrogen or helium.

6. The method of claim 1, wherein said step of urging said ions through said gas comprises urging the ions through said gas at a pressure between $10^{-3}$ mbar and $10^{-1}$ mbar.

7. The method of claim 1, wherein said step of reacting said analyte ions comprises supplying reagent ions or charged particles to said analyte ions so as to result in electron transfer reactions to or from said analyte ions, proton transfer reactions to or from said analyte ions, or electron capture by said analyte ions.

8. The method of claim 1, wherein the method reduces the charge state of the analyte ions to singly or doubly charged product ions.

9. The method of claim 1, comprising selecting or varying the charge state desired for the product ions and comprising selecting or varying the energy with which said analyte ions are collided with the gas molecules such that at least some of said analyte ions are reduced in charge state to said desired charge state.

10. The method of claim 1, comprising generating multiply charged analyte ions, and then performing said charge reduction steps on the multiply charged analyte ions.

11. The method of claim 1, comprising performing a scan mode in which the analyte ions are analysed so as to determine the charge state of the analyte ion that has the most intense signal.

12. The method of claim 1, comprising isolating analyte ions having a selected charge state from other ions, or isolating said analyte ions having the charge state that has said most intense signal; and then subjecting these isolated ions to said step of reacting said analyte ions and to said collisions with the gas molecules.

13. The method of claim 1, further comprising mass analysing and/or ion mobility analysing said product ions; and/or further comprising identifying said product ions and/or using said product ions to identify said analyte ions or to identify an analyte from which said analyte ions are formed.

14. The method of claim 1, wherein the analyte ions are selected from the group consisting of: polymer ions; biopolymer ions; pegylated polymer ions; pegylated proteins ions; native protein ions; monoclonal antibody ions; recombinant monoclonal antibody drug ions; non-covalently bound protein complex ions; ions of protein complexes in their native state; bio-conjugated drug ions, such as pegylated protein or lipid ions; RNA or DNA ions; and haemoglobin ions.

15. A method of mass spectrometry comprising:

(i) mass selectively isolating analyte ions having mass to charge ratios below an upper threshold;

(ii) charge stripping the isolated analyte ions according to a method as claimed in claim 1 so as to form said product ions; and then (iii) mass analysing the product ions so as to obtain spectral data;

(iv) identifying ions, or determining the presence of ions, in the spectral data having a mass to charge ratio above said upper threshold.

16. The method of claim 15, wherein said step of isolating the analyte ions is performed by mass filtering ions or by using a mass selective ion trap.

17. The method of claim 16, wherein said step of isolating the analyte ions isolates ions of a single mass to charge ratio, or isolates ions having mass to charge ratios between a lower threshold and said upper threshold.

* * * * *